US009275620B2

(12) United States Patent
Huston et al.

(10) Patent No.: US 9,275,620 B2
(45) Date of Patent: Mar. 1, 2016

(54) FLEXIBLE PRINTED CIRCUIT BOARD PICKUP FOR STRINGED INSTRUMENTS AND METHOD OF USING THE SAME

(71) Applicant: Purdue Research Foundation, West Lafayette, IN (US)

(72) Inventors: Davin Howard Huston, West Lafayette, IN (US); Richard Mark French, West Lafayette, IN (US); Kathryn Lee Lupacchino, Fishers, IN (US)

(73) Assignee: PURDUE RESEARCH FOUNDATION, West Lafayette, IN (US)

( * ) Notice: Subject to any disclaimer, the term of this patent is extended or adjusted under 35 U.S.C. 154(b) by 0 days.

(21) Appl. No.: 14/480,697

(22) Filed: Sep. 9, 2014

(65) Prior Publication Data

US 2015/0068392 A1 Mar. 12, 2015

Related U.S. Application Data

(60) Provisional application No. 61/876,341, filed on Sep. 11, 2013.

(51) Int. Cl.
*G10H 3/18* (2006.01)
*G10H 3/14* (2006.01)

(52) U.S. Cl.
CPC ..... *G10H 3/181* (2013.01); *G10H 3/143* (2013.01)

(58) Field of Classification Search
CPC ..... G10H 3/181; G10H 1/32
USPC ..... 84/726–728
See application file for complete search history.

(56) References Cited

U.S. PATENT DOCUMENTS

| | | | | |
|---|---|---|---|---|
| 4,854,210 | A * | 8/1989 | Palazzolo | 84/726 |
| 4,878,412 | A * | 11/1989 | Resnick | 84/726 |
| 5,168,117 | A * | 12/1992 | Anderson | 84/726 |
| 5,391,832 | A * | 2/1995 | Lace | 84/726 |
| 8,319,088 | B1 * | 11/2012 | Harari | 84/727 |
| 2012/0103169 | A1 * | 5/2012 | Lingel | 84/726 |
| 2013/0333545 | A1 * | 12/2013 | Dunwoodie | 84/726 |

* cited by examiner

*Primary Examiner* — Jeffrey Donels
(74) *Attorney, Agent, or Firm* — Purdue Research Foundation

(57) ABSTRACT

A retrofit pickup assembly for stringed instruments is disclosed. The retrofit pickup assembly includes an existing coil and existing or new magnets and a flexible circuit having a plurality of wires and two connectors. A pickup assembly for new stringed instruments is also disclosed utilizing the same principles. A method of retrofitting an existing pickup assembly for stringed instruments is also disclosed.

15 Claims, 12 Drawing Sheets

FLEXIBLE PRINTED CIRCUIT BOARD PICKUP FOR STRINGED INSTRUMENTS AND METHOD OF USING THE SAME

CROSS-REFERENCE TO RELATED APPLICATIONS

The present U.S. patent application is related to and claims the priority benefit of U.S. Provisional Patent Application Ser. No. 61/876,341 filed Sep. 11, 2013, the contents of which are hereby incorporated by reference in its entirety into the present disclosure.

TECHNICAL FIELD

The present disclosure generally relates to stringed instruments and in particular to string instruments suitable for a pickup component.

BACKGROUND

Powered stringed instruments are prevalent. One of the most commonplace powered stringed instruments is the electric guitar. Typically, an electric guitar has six steel strings stretched between tuning machines (knob-gear arrangements for each of the strings), and a bridge where the strings terminate. On a solid body guitar, one or more electromagnetic pickups are disposed on the body of the guitar directly under the strings.

In order to amplify stringed instruments, the pickup converts string motion into a proportional voltage. A common type being used is an electromagnetic, inductive design. This type of pickup was originally developed in the 1930s and set the pattern for subsequent designs. The most basic type of inductive pickup uses a copper wire coil surrounding one or more permanent magnets. A representative pickup is shown in FIG. 1, which is a schematic representation of a spool assembly of a magnetic pick-up of a stringed instrument according to prior art.

Referring to FIG. 1, a spool assembly 10 typically includes a composite material that is used as a bobbin 11 to wrap electrical wiring coil 12. The number of turns in the coil 12 varies, in some embodiments the number is of the order of 6500 turns. The wires forming the coil 12 are generally made of copper with very thin (and fragile) polymer insulation. The coil terminates in wire-ends 13 and 14, which are respectively connected to (e.g., soldered) ends of the coil 12. The ends of the coil 12 are shown as white lines 16 and 18 for clarity. A plurality of permanent magnets 15 is positioned above the bobbin. The magnets 15 are generally made of Alnico, an alloy composed of aluminum, nickel and copper. Rare earth magnetic materials such as Neodymium or Samarium-Cobalt are also used, although seldom. Still other materials known in the art may be used.

The strings of the guitar (not shown) are positioned above the magnets 15. The electromagnetic field produced by the permanent magnet(s) 15 is normally stationary. However, the vibration of the steel strings disturbs the electromagnetic field and makes it vary. The interaction between the changing electromagnetic field or the changing magnetic flux and the stationary coil induces a time-varying voltage in the coil 12. The time-varying signal can be then amplified and played through speakers as sounds.

Pickup designers typically vary a small number of parameters in order to tailor the tonal characteristics. These are: 1) Diameter of coil wire; 2) Number of turns in the coil; 3) Magnet geometry; and 4) Magnet material. The relatively small number of design variables limits pickup designs.

Single coil pickups are sensitive to 60 Hz line noise in addition to string motion. As a result, a 60 Hz hum is often superimposed over the sound due to string motion. To overcome this undesired attribute, a dual pickup system, commonly known as the Humbucker design, was developed to take advantage of common mode rejection. The Humbucker design (not shown) includes two spool assemblies positioned adjacent one another in order to eliminate the 60 Hz hum (noise) that is induced into the coils.

Another design modification and evolution in the electric guitar technology is the addition of active circuitry to pre-amplify the signal at the pickup. Since the generated time-varying signals are low in power, traveling over a long distance before reaching the amplifier results in attenuation. By using a pre-amplifier at the pickup, the distance travelled and hence ohmic attenuation, prior to actively amplifying the signal at a main amplifier can be minimized.

It should be noted that conventional pickups are large and heavy. The presence of magnets and coils of copper wire can make these pickups excessively heavy for acoustic instruments and thereby these pickups are suited mostly to solid body electric stringed instruments. The size of the conventional pickup means that large pockets must be provided on the stringed instrument bodies to accommodate the pickup. Furthermore, conventional pickups are difficult to manufacture. Winding thousands of turns of wire that are as thin as human hair is difficult and time consuming. In many cases, the first 100-200 turns of the coil 12 can be shorted out by the pressure of successive turns of wire, thereby compromising the insulation. Also, it is difficult to make each coil identical, but build variation can result in a variation of sound, with all other conditions being the same. The coil wires can be microphonic. Also, the moving electromagnetic field sensed by the coil wire creates a force on both the moving wire as well as stationary wires in order to prevent the movement of the moving wire in the magnetic field. Unless the wire is firmly restrained, it can move and cause undesirable signals.

Therefore, a novel pickup arrangement for string instruments is needed that can be used as a kit in new instruments or to retrofit existing instruments to overcome some or all of the shortcomings of the prior art pickups.

SUMMARY

A retrofit pickup assembly for a stringed musical instrument is disclosed. The retrofit pickup assembly includes an existing pickup assembly with an existing coil wound about a bobbin and a plurality of magnets disposed on the bobbin. Each of the magnets is configured to be placed under a string of the stringed musical instrument. The retrofit pickup assembly further includes a flexible circuit having a plurality of wires and two connectors forming a coil when the connectors are engaged. The flexible circuit terminates at terminals and the flexible circuit is configured to be placed over the bobbin and around the coil of the existing pickup assembly. The assembly thus provides signals from the terminals to a downstream circuit based on movements of the strings of the stringed musical instrument.

A pickup assembly for a new stringed musical instrument is also disclosed. Such a pick-up assembly includes a pickup assembly having a housing and a plurality of magnets disposed on the housing. In this assembly, each magnet is configured to be placed under a string of the stringed musical instrument. The assembly further includes a flexible circuit having a plurality of wires and two connectors forming a coil when the connectors are engaged, and the flexible circuit terminates at terminals. Further, the flexible circuit is configured to be placed within the housing to provide signals from the terminals to a downstream circuit based on movements of the strings of the stringed musical instrument.

A flexible sensor arrangement for a magnetic stringed musical instrument pickup is disclosed. The arrangement includes an elongate flexible substrate having first and second ends, and the flexible substrate is configured to be placed over a bobbin of the magnetic stringed instrument pickup. The arrangement further includes first and second connectors disposed at the first and second ends of the substrate. The elongate flexible substrate contains a plurality of conducting wires insulated from one another are disposed along the length of the substrate between the first and second connectors. The arrangement has a first terminal electrically connected to a first one of the plurality of wires. The arrangement also has a second terminal electrically connected to a second one of the plurality of wires. The arrangement is such that the plurality of wires form a coil when the first and second connectors are engaged.

BRIEF DESCRIPTION OF DRAWINGS

While some of the figures shown herein may have been generated from scaled drawings or from photographs that are scalable, it is understood that such relative scaling within a figure is by way of example, and is not to be construed as limiting.

DETAILED DESCRIPTION

Figure 1:
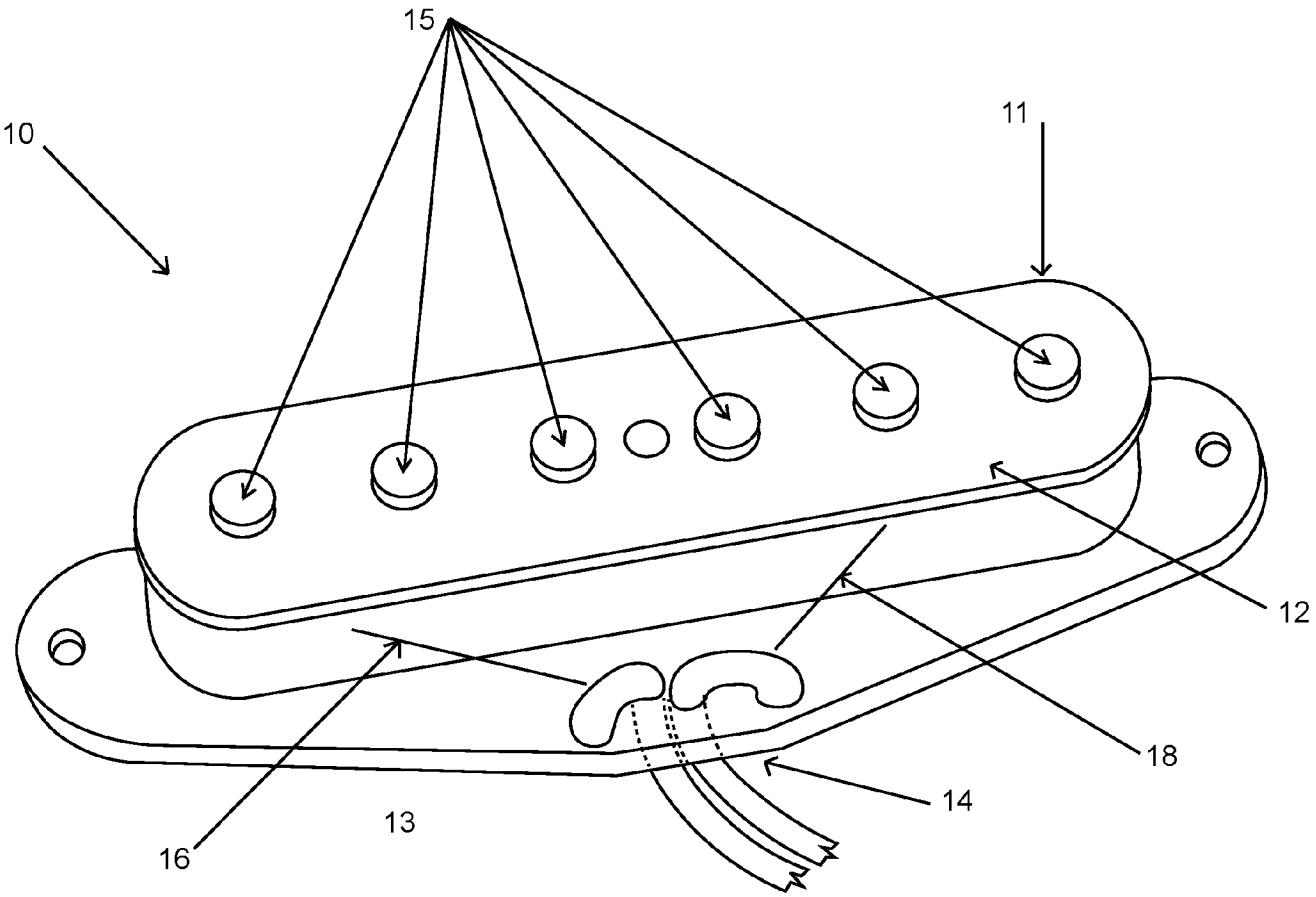
FIG. 1 (Prior Art)
FIG. 1 is a spool assembly of a magnetic pick-up of a stringed instrument according to prior art.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

A novel pickup arrangement is provided that addresses the shortcomings of the prior art pickups discussed above. The novel pickup arrangement can be used as a retrofit kit with existing instruments having existing pickups or on a new instrument as a new pickup.

Figure 2:
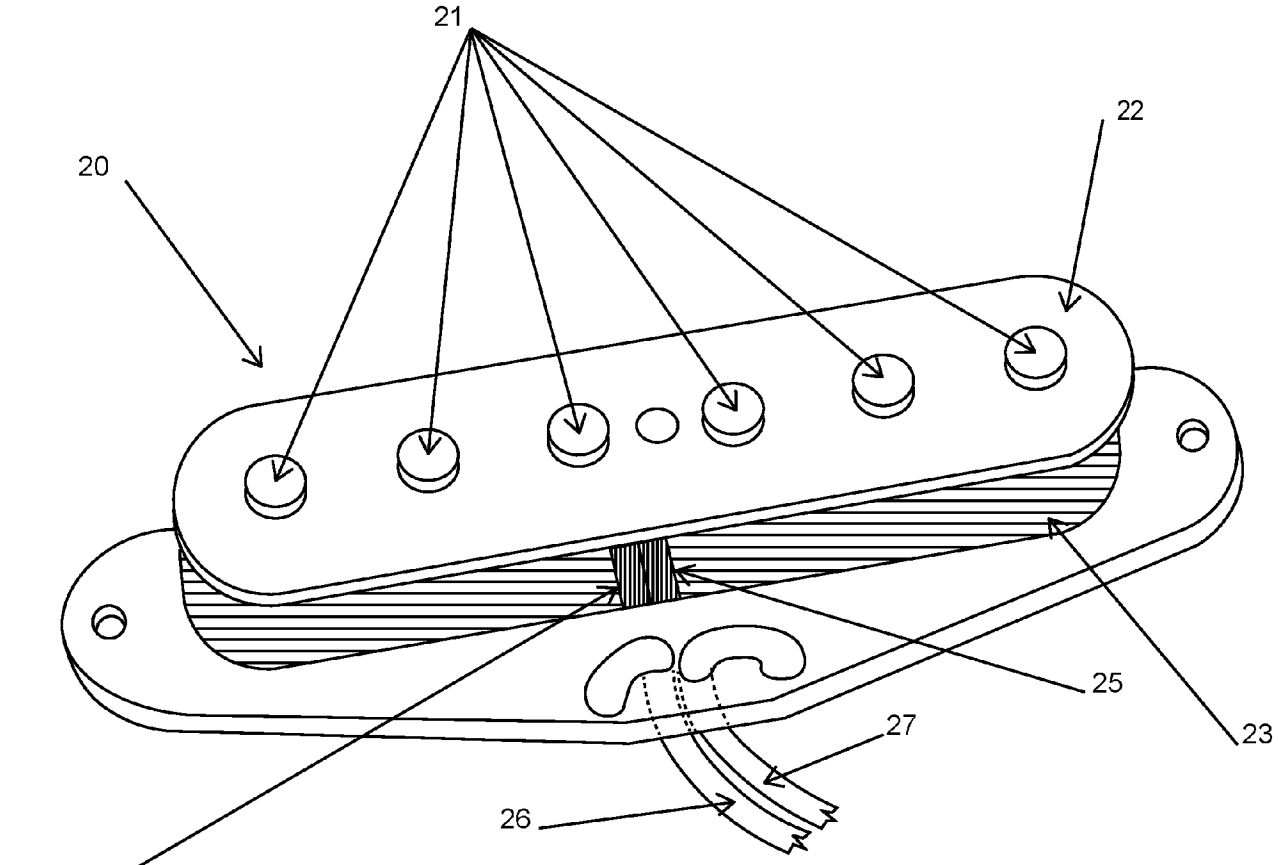
FIG. 2 is a schematic representation of the novel flexible pickup arrangement according to the present disclosure.

Referring to FIG. 2, the novel flexible pickup arrangement according to the present disclosure is presented in association with the pickup of the prior art. The flexible pickup arrangement may be provided as a retrofit assembly or it may be provided as a new assembly. In either case, the arrangement includes a spool assembly 20, one or more magnets 21 (typically one magnet per string), a bobbin 22, a flexible circuit 23 and a pair of connectors 24 and 25 (depicted more clearly in FIG. 3). Each member of the connector pair is coupled to a corresponding end of the flexible circuit. The connectors may be configured to be slideable to provide circumferential adjustability.

A flexible sensor arrangement according this disclosure comprises a flexible circuit 23 and a pair of connectors 24 and 25. In a preferred embodiment, the flexible circuit 23 has first and second ends 26 and 27. In this disclosure, flexible circuit 23 comprises a flexible substrate which contains a plurality of conducting wires insulated from one another and disposed along the length of the substrate between the first and second conductors. The flexible substrate is configured to be placed over a bobbin of a magnetic stringed instrument pick-up. As mentioned before, the flexible circuit comprises a plurality of wires insulated from one another disposed along the length of the flexible substrate. While we use the term wires here, no limitation of geometry is implied. Instead of wires we can have other geometries such as conductor lines typically found in circuit boards and printed circuits. The wires also understood to be conductors of other geometries, are electrically insulated from one another. Here, by insulation we mean a separation by dielectric layers (in the case of a multi-layer substrate) or just spacings between wires and/or conductor traces on a surface. The flexible circuit may contain multiple layers, each containing a plurality of conductor wires. The circuits can also be double-sided. In such 2-sided substrates, necessary interconnections can be made by use of vias or through-holes in the flexible substrate. In multilayers substrates, needed interconnections between layers are made through vias in the insulating dielectric layers. These techniques are well known in the flexible printed circuit industry. The flexible sensor arrangement includes a first terminal electrically connected to a first one of the plurality of wires in the flexible circuit. It also includes a second terminal connected to a second one of the plurality of wires. It is to be noted that when the flexible substrate containing the plurality of wires is configured to be placed over a bobbin of a magnetic stringed instrument pickup, the plurality of wires forma coil. Once again, in this disclosure, it should be understood that the term "wire" also means conductors of different geometry, such as conductor patterns, traces found in flexible printed circuits. In the flexible sensor arrangement described here, the coil formed by the plurality of the wires and the configuration of the flexible substrate around the bobbin, can be utilized to sense magnetic field disturbances caused by movement of strings in a stringed musical instrument. This is further detailed in the following paragraphs.

Flexible circuits are well known in the electronics industry. The substrates for such circuits include flexible materials such as polyimide. Many other substrate materials are well known to those of ordinary skill in the art. Flexible printed circuits are generally made utilizing photolithographic technology.

Wire-ends 26 and 27 are depicted in FIG. 2. The wire-ends are present in the retrofit embodiment. However, in a new assembly embodiment these wire ends 26 and 27 may be eliminated. Not shown in FIG. 2 are terminals (depicted in FIG. 3) that are coupled to the flexible circuit 23 and the pair of connectors. Also, not shown in FIG. 2 are the wires (see FIG. 1) forming the native coil that is being retrofitted by the arrangement of the present disclosure. In the case of an existing coil, the wire ends need to be cut and attached to the wire-end (not shown) of the flexible circuit.

Figure 3:
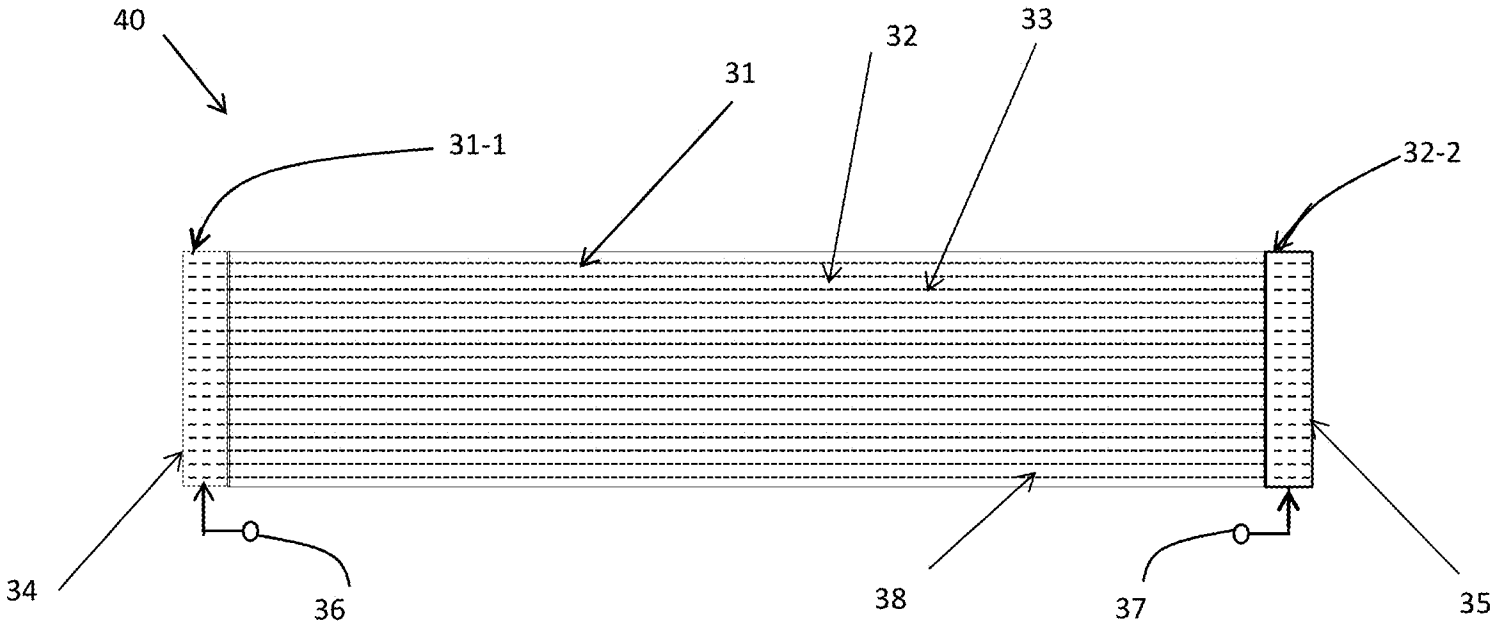
FIG. 3 is a schematic representation of one embodiment of a flexible circuit.

Referring to FIG. 3, one embodiment of a flexible circuit is depicted. The flexible circuit 30 shown in FIG. 3 includes wires that are insulated from one another (therefore, shown in FIG. 3 as dashed lines), and are provided continuously such that end of each wire is connected to an adjacent wire in an alternating end to end fashion. (These wires are labeled 31, 32, 33 for wires 1, 2 and 3 respectively. The numbering of the wires can continue as needed. The last wire is labeled, Wire N, is labeled 38 in FIG. 3). Therefore, Wire 31 extends from End 31-1 to End 32-2 and loops at End 32-2 and extends as Wire 32. Wire 32 loops at End 31-1 and extends as Wire 33. The same arrangement repeats until Wire N, labeled as 38 in FIG. 3. The looping of wires can be accomplished within each connector (i.e., the connector can be part of the electrical conductivity, that is the electrical conductivity established once the connectors are coupled to each other), or the connectors can be configured to simply provide a mechanical connectivity (i.e., the looping can be configured to occur independent of the connectors).

Two terminals are depicted in FIG. 3. The Terminal (Out-A) labeled as 36 in FIG. 3 is configured to be coupled to one wire, e.g., the Wire 1, labeled as 31, and the Terminal (Out-B) labeled as 37 in FIG. 3 is configured to be coupled to another wire, e.g., the Wire N, labeled as 38. These terminals provide connectivity to/from the flexible circuit and from/to downstream circuits (not shown).

Figure 4:
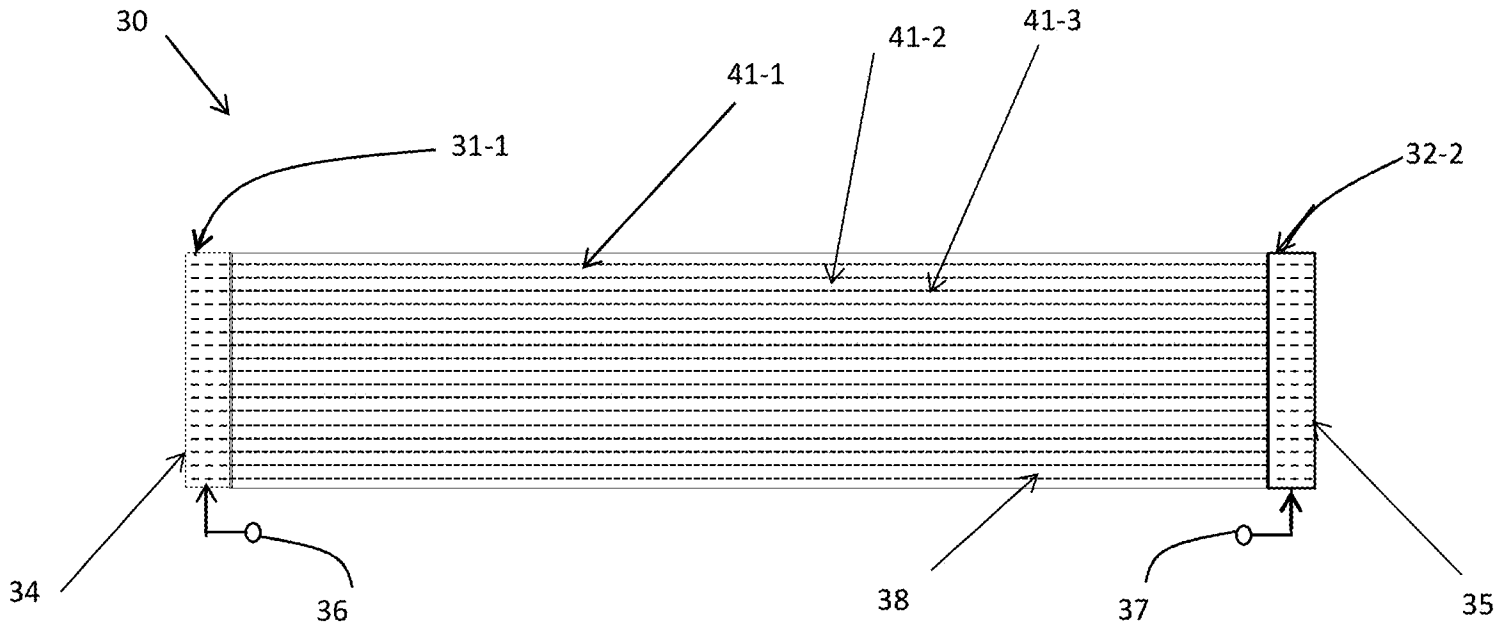
FIG. 4 is a schematic representation of one embodiment of a multi-layer flexible circuit.

The flexible circuit 23 may be configured to have more than one layer of wire. These layers can be coupled to each other to form a packed bundle or ribbon-like cable. Referring to FIG. 4, one embodiment of a multi-layer flexible circuit is depicted. The multi-layer flexible circuit 40 includes wires that are insulated from one another (therefore, shown in FIG. 4 as dashed lines), and are provided continuously such that end of each wire is connected to an adjacent wire in an alternating end to end fashion. Therefore, Wire 41-1 extends from End 1 labeled as 31-1 to End 2 labeled as 32-2 and loops at End 2 (labeled as 32-2) and extends as Wire 41-2. Wire 41-2 loops at End 1 (labeled as 31-1) and extends as Wire 41-3. The same arrangement repeats until Wire 41-N, labeled as 38. Wire 41-N is then coupled (not shown) to Wire 42-1 (not shown) which can be positioned next to Wire 41_N, labeled as 38 to achieve minimal resistance. The looping of wires can be accomplished within each connector (i.e., the connector can be part of the electrical conductivity, that is the electrical conductivity established once the connectors are coupled to each other), or the connectors can be configured to simply provide a mechanical connectivity (i.e., the looping can be configured to occur independent of the connectors).

Figure 5:
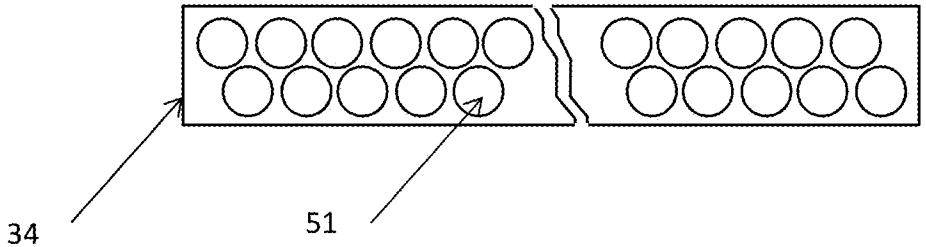
FIG. 5 is a schematic representation of a plurality of socket/pin combinations that can be employed in one embodiment of this disclosure.

According to one embodiment, each member of the connector pair (34 and 35 in FIG. 3) is configured to have a plurality of matching pins and sockets (51 in FIG. 5 is an example of a socket/pin combination) as depicted in FIG. 5 in a male/female fashion. One member of the connector pair is configured to fit within the other member in order to establish connectivity.

Figure 6:
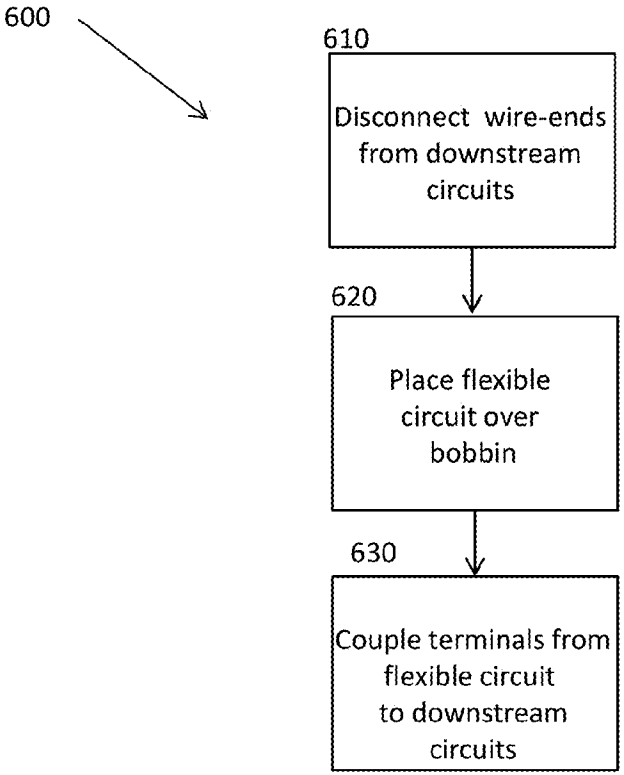
FIG. 6 is a flow chart describing the retrofitting steps according to the present disclosure.

Referring to FIG. 6, a flow chart 600 is provided to describe the retrofitting steps. Initially, the wire-ends (see FIG. 1 or 2) coupled to the wires forming the coil wound around a bobbin of an existing pickup assembly are disconnected (step 610) from the downstream circuits (not shown). Once the original coil is disconnected, the flexible circuit having a plurality of wires formed in a loop terminating at terminals and connectors is placed over the bobbin and around the coil of the pickup (step 620) (see FIG. 2). Next, the terminals of the flexible circuit are coupled to the downstream (step 630) circuits (not shown).

Figure 7:
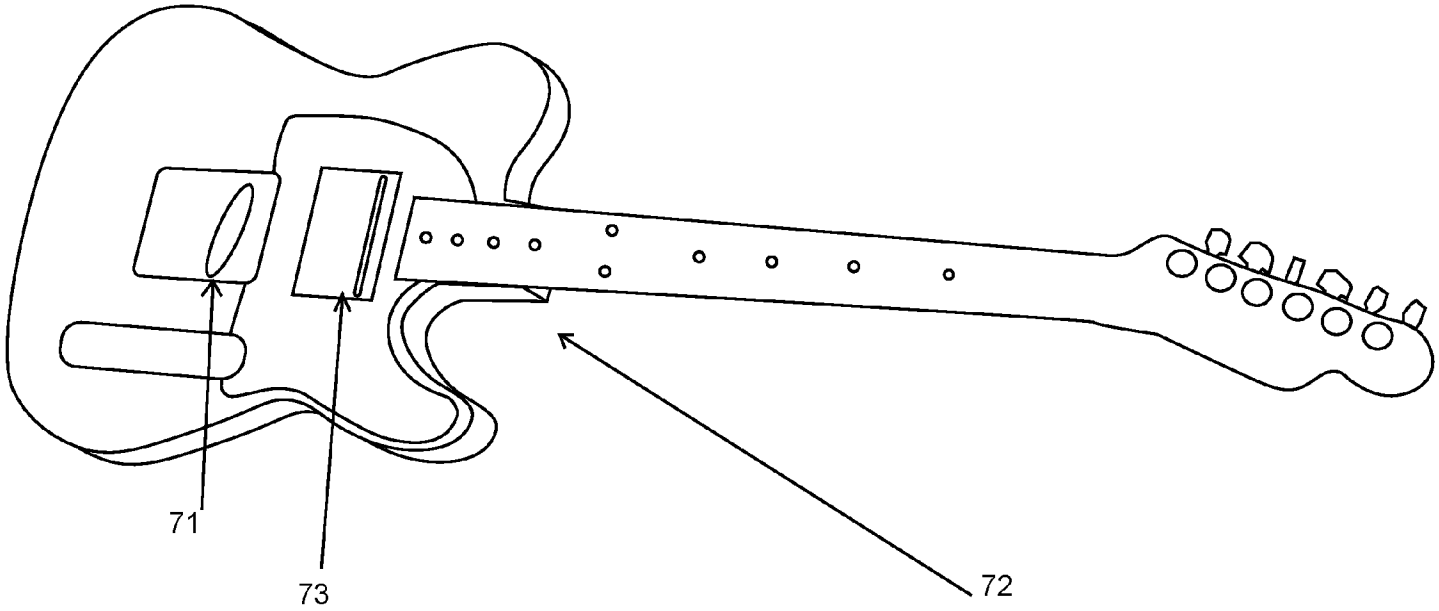
FIG. 7 is a depiction of an exemplary pickup with a flexible circuit arrangement according to the present disclosure placed on a stringed instrument.

It should be appreciated that while throughout the present disclosure the flexible circuit arrangement is exemplified with an electric guitar, no such limitation is intended and the novel flexible circuit arrangement can be used with any stringed instrument that uses strings made with ferrous materials or materials that can interact with the magnetic field of the magnets used in the pickups. Referring to FIG. 7, an exemplary pickup with a flexible circuit arrangement 71 placed on a stringed instrument 72, an electric guitar, is depicted. The flexible circuit arrangement can be used in an original equipment manufacturing application where the stringed instrument is manufactured with the novel flexible circuit arrangement. The exemplary pickup with a flexible circuit arrangement shown in FIG. 7 can also be used as a retrofit application where the conventional pickup is retrofitted by the flexible circuit according to the present disclosure. Also depicted in FIG. 7 is an active circuit board 73 that can be used with the flexible circuit arrangement to pre-amplify signals received from the flexible circuit arrangement prior to communicating the pre-amplified signal to a main amplifier downstream.

Figure 8:
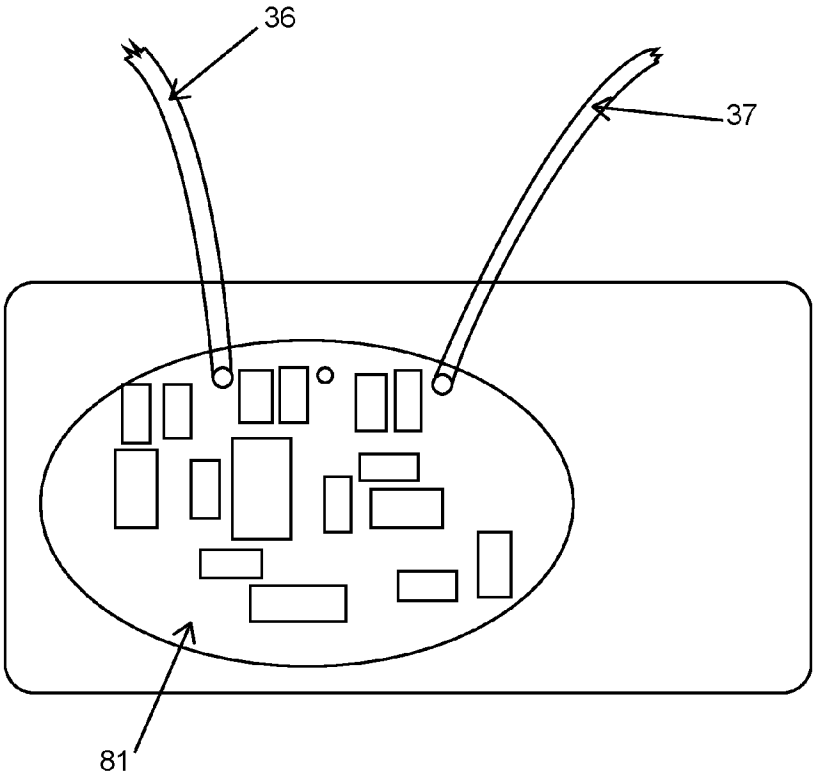
FIG. 8 is a depiction of the circuit board of the flexible circuit arrangement according to the present disclosure.
Figure 9A:
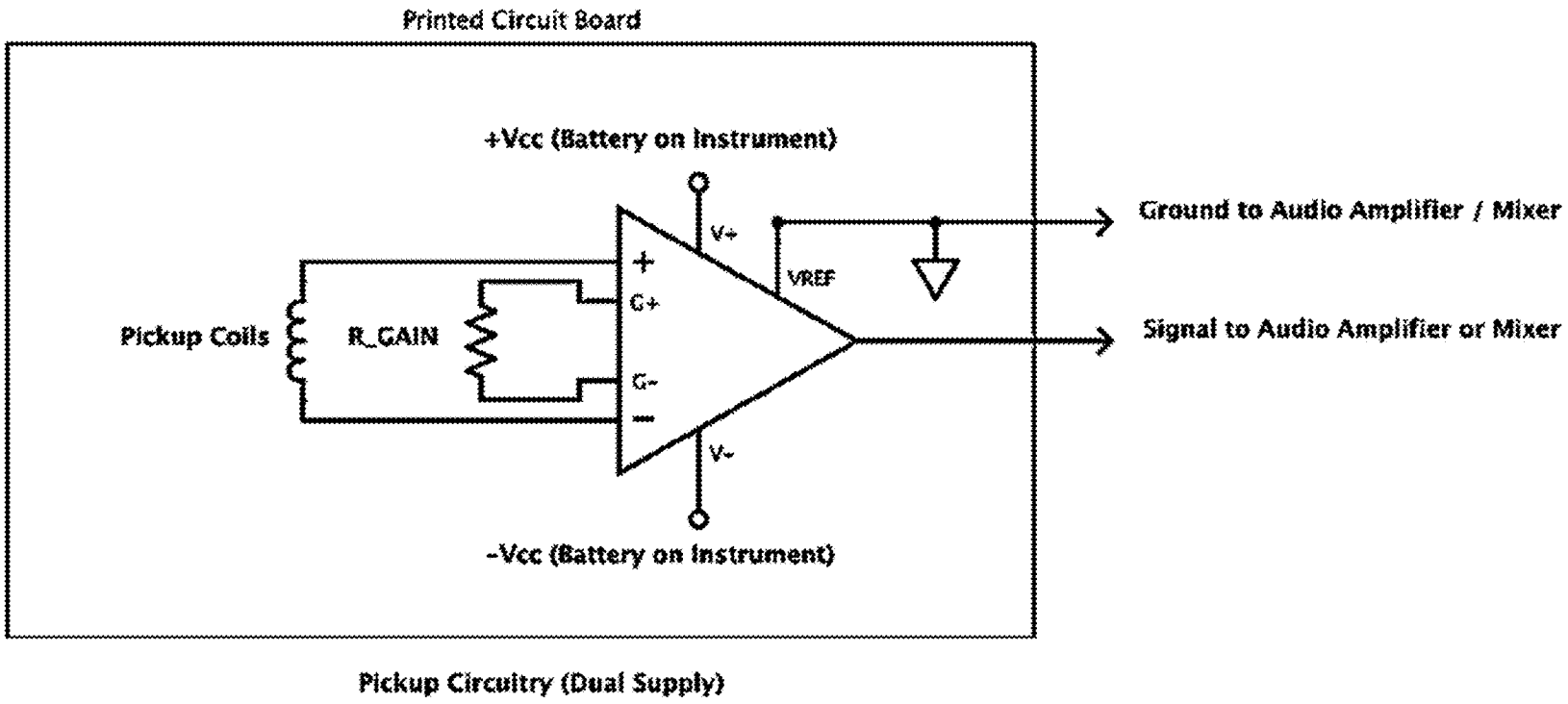
FIGS. 9(*a*) through 9(*d*) are depictions of four different embodiments of the active pre-amplifier circuit.
Figure 9B:
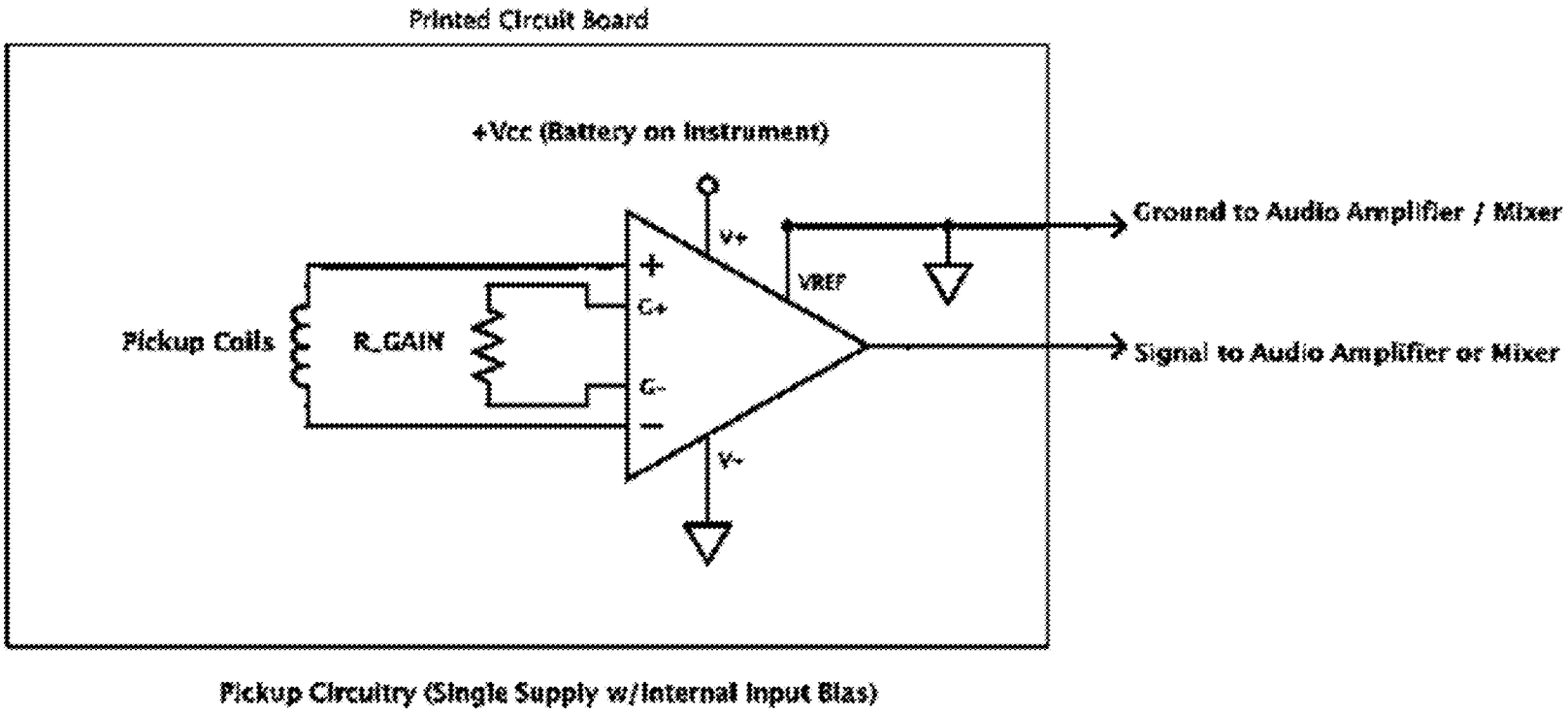
Figure 9C:
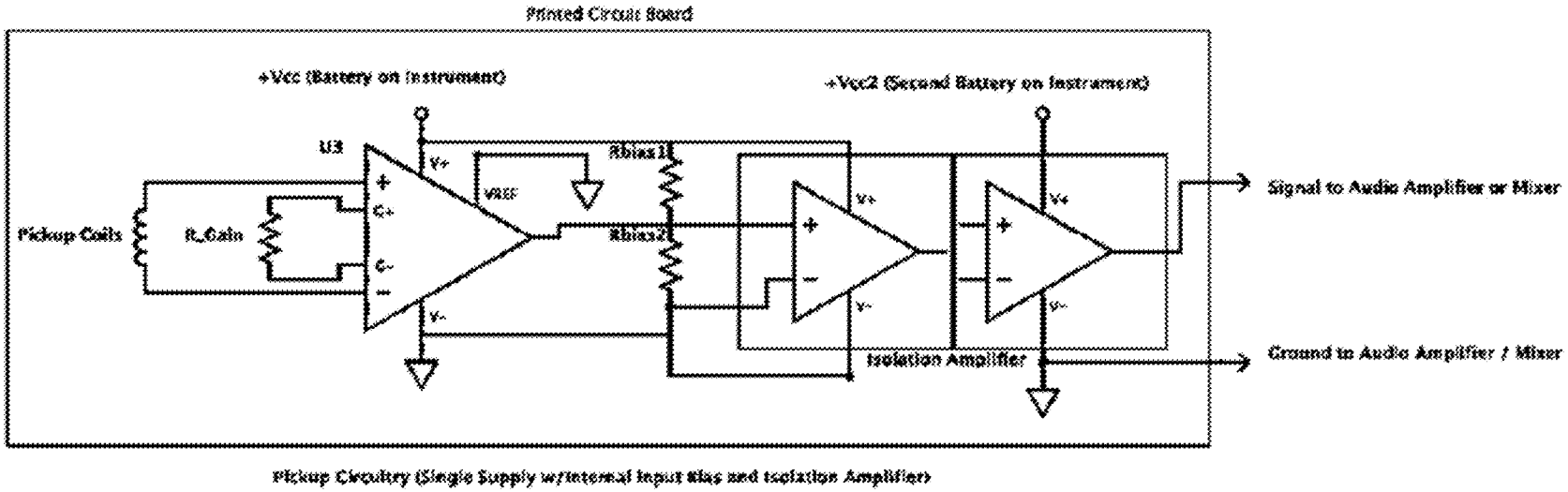
Figure 9D:
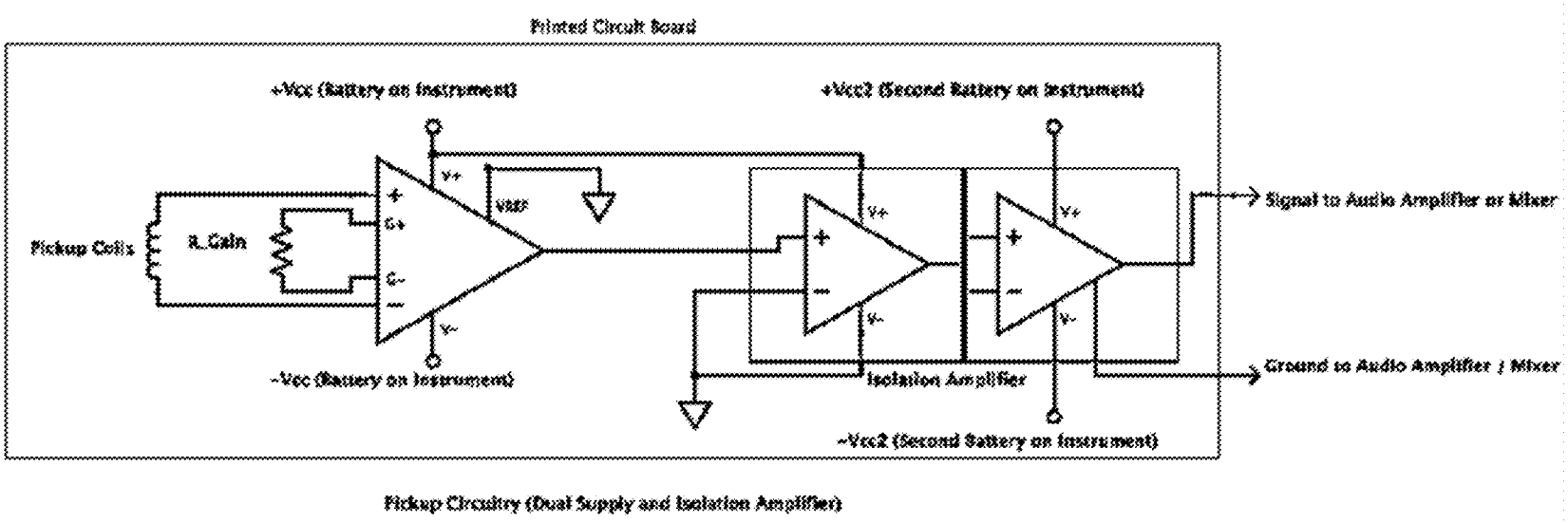

Referring to FIG. 8 the circuit board 73 of the flexible circuit arrangement according to the present disclosure is depicted, according to one embodiment. The circuit board can be a multi-layer circuit board with surface mount devices mounted thereon. The circuit board includes the active pre-amp circuit 81. The layers can be configured to include vias, allowing the traces to compactly form in a small area. The circuit board can be an FR4 board configured for surface mount, flip chip, or dual in-line package components. Alternatively, the circuit board 73 can be a ceramic board configured to provide environmental protection. Other substrate materials are possible as would be recognized by those of ordinary skill in the art. Non-limiting examples of substrates for the circuits of this disclosure include Aluminum Nitride, Alumina, Insulated metal substrates such as porcelainized steel, High Temperature Co-fired Ceramic (HTCC), and Low-Temperature Co-fired Ceramic (LTCC). In FIGS. 8, 36 and 37 have the same significance as 36 and 37 of FIG. 3, namely, Terminal (Out-A) and Terminal (Out-B).

In the flexible circuit arrangement, the magnets can be made from the same material of magnets in conventional pickups or of rare-earth magnet material. For example, the magnets can be made of Alnico, an alloy composed of aluminum, nickel and copper, or alternatively of rare-earth magnetic materials such as Neodymium or Samarium-Cobalt.

The circuit board of the novel flexible circuit arrangement of the present disclosure may also include an active pre-amplifier circuit coupled to the flexible circuit. Referring to FIGS. 9(*a*)-9(*d*), four embodiments of the active pre-amplifier circuit are depicted. In each of these embodiments, the "pickup coils" refers to the flexible circuit. Referring to FIG. 9(*a*), a dual-supply differential pre-amplifier circuit is depicted. The inputs to the pre-amplifier are the terminals of the flexible circuit. The output of the dual-supply differential pre-amplifier is provided to main downstream audio amplifier (or the main audio amplifier) or mixer. Alternatively, and Referring to FIG. 9(*b*), a single-supply differential amplifier is depicted. The differential amplifier used in this embodiment has an internal-bias to insure that the input signal is amplified without negative clipping of the input signal from the pickup coils. The output of the single-supply differential pre-amplifier is provided to the main downstream audio amplifier or mixer (not shown).

Referring to FIGS. 9(*c*) and 9(*d*), an isolation amplifier is depicted which can be used after the differential amplifier stages; one embodiment is a single-supply version (FIG.

9(*c*)), and the other embodiment is the dual-supply version (FIG. 9(*d*)). The isolation amplifier isolates the flexible circuit's ground from the ground of the main downstream audio amplifier or mixer (not shown). That is, the input stage of the isolation pre-amplifier which includes the inputs from the coil assembly is supplied by $V_{CC}$ which is the power source for the flexible circuit arrangement (e.g., a first battery on the stringed instrument), while the output stage of the isolation pre-amplifier is powered by a separate power source $V_{CC2}$ (e.g., a second battery on the stringed instrument), which is separate from the $V_{CC}$. In one of the embodiments, the input stage also includes biasing resistors $R_{Bias}$, which are used to form a voltage divider circuit based on $V_{CC}$. The $R_{Bias}$ resistors do not have to be of equal value. These resistors provide a DC offset to compensate for the lack of a negative supply on the isolation pre-amplifier and prevent the clipping of the negative voltage of the input signal. The isolation pre-amplifier is configured to provide isolation for the player of the stringed instrument, thereby configured to prevent electrocution. The isolation pre-amplifier allows for the stringed instrument and the instrument's downstream amplifier to remain separate from each other electrically. This can prevent accidental electrocution in case of a ground fault in the building that could energize the metallic components of the instrument. The output of the isolation pre-amplifier can be filtered by placing a capacitor in series with the output prior to feeding the output to the main amplifier. The capacitor is configured to remove any direct current (DC) offset.

It is to be noted that many stringed instruments use electronic effects to change the nature of the sound produced by the instruments. These effects are generally produced using dedicated floor-mounted devices (also known as stomp boxes) through which the signal flows before reaching the main amplifier. While not shown, it should be appreciated that the active circuit may also be configured to house circuitry that might otherwise be in a stomp box. Dedicated circuitry might add a small number of effects that could be controlled by the player through switches or buttons built into the stringed instrument. Also, a player may be able to control these effects by waving an RFID card to select the frequency response of the circuit to that of a preloaded filter. These effects could also be stored on an external storage device (e.g., SD card, USB thumb drive, etc.) or associated with the pre-amplifier effects circuitry itself. The effects output can be mixed with the output signal of the pre-amplifier.

It should also be appreciated that the flexible circuit arrangement of the present disclosure can also be provided with the flexible circuit formed of the conductive traces and the magnets, as described above and depicted in FIG. 2 without inclusion of the active circuitry. Such an arrangement (i.e., non-active flexible circuit) is advantageous over a conventional pickup of the prior art (as depicted in FIG. 1), since the flexible circuit deployed in a retrofit manner or in an original manufacturing setup addresses various shortcomings of the conventional pickup such as variations in manufacturability of the coil, durability of the wires to the outside environment, etc. It should be recognized that materials other than those mentioned above can be used as materials for the magnets described on this disclosure.

Several advantages exist for the magnetic pickup assembly embodiments of the present disclosure. Utilizing flexible printed circuits eliminates enormous labor associated with wire windings. Further, the robustness of the printed circuits can have significantly fewer defects in insulation. For these reasons, there can be a significant reduction in the number of wires or conductor traces required. This can reduce the number of coils of wire (or conductors of different geometry as mentioned before), from several thousand to less than 60. Further, the compactness of the flexible sensor arrangement may lend itself to placing the pre-amplification circuitry and amplification circuitry in closer proximity to the coil resulting in decreased susceptibility to electromagnetic interference (EMI).

Another embodiment of the approach described in the disclosure is a pickup assembly for a new stringed musical instrument. In such an embodiment, the pickup assembly includes a housing and a plurality of magnets disposed on the housing, each magnet configured to be placed under a string of the stringed musical instrument. Similar to the retrofit pickup assembly, the pickup assembly for new stringed instruments includes a flexible circuit having a plurality of wires and two connectors forming a coil when the connectors are engaged, such that the flexible circuit terminates at terminals. Further, the flexible circuit is configured to be placed within the housing to provide signals from the terminals to a downstream circuit based on movements of the strings of the stringed musical instrument.

While the present disclosure has been described with reference to certain embodiments, it will be apparent to those of ordinary skill in the art that other embodiments and implementations are possible that are within the scope of the present disclosure without departing from the spirit and scope of the present disclosure. It is therefore intended that the foregoing detailed description be regarded as illustrative rather than limiting.

The invention claimed is:

1. A retrofit pickup assembly for a stringed musical instrument, comprising:

an existing pickup assembly having an existing coil wound about a bobbin and a plurality of magnets disposed on the bobbin, each magnet configured to be placed under a string of the stringed musical instrument; and a flexible circuit having a plurality of wires and two connectors forming a coil when the connectors are engaged, the flexible circuit terminating at terminals, wherein the flexible circuit is configured to be placed over the bobbin and around the coil of the existing pickup assembly to provide signals from the terminals to a downstream circuit based on movements of the strings of the stringed musical instrument.

2. The retrofit pickup assembly of claim 1, further comprising a pre-amplifying circuit coupled to the terminals and configured to pre-amplify signal communicated from the flexible circuit to the downstream circuit.

3. The retrofit pickup assembly of claim 2, the pre-amplifying circuit comprising a two-source amplifier, the ground of each source isolated from the ground of the downstream amplifier.

4. The retrofit pickup assembly of claim 2, further comprising a sound effect circuit coupled to the pre-amplifying circuit and configured to add sound effects to the pre-amplified signal.

5. The retrofit pickup assembly of claim 1, wherein the magnets are composed of one of Alnico, Neodymium, and Samarium-Cobalt.

6. A pickup assembly for a stringed musical instrument, comprising:

an elongate housing;

a plurality of magnets disposed on the housing, each magnet configured to be placed under a string of the stringed musical instrument; and a flexible circuit having a plurality of wires and two connectors forming a coil when the connectors are engaged, the flexible circuit terminating at terminals, wherein the flexible circuit is configured to be placed about the housing to provide signals from the terminals to a downstream circuit based on movements of the strings of the stringed musical instrument.

7. The pickup assembly of claim 6, further comprising a pre-amplifying circuit coupled to the terminals and configured to pre-amplify signal communicated from the flexible circuit to the downstream circuit.

8. The pickup assembly of claim 7, the pre-amplifying circuit is an isolation amplifier with an input stage and an output stage, the input stage powered by a different power source than the output stage, the ground of each power source isolated from the ground of the downstream amplifier.

9. The pickup assembly of claim 8, the pre-amplifying circuit is a single source amplifier, the ground of the single source isolated from the ground of the downstream amplifier.

10. The pickup assembly of claim 7, the pre-amplifying circuit is a two source amplifier, the ground of each source isolated from the ground of the downstream amplifier.

11. The pickup assembly of claim 7, further comprising a sound effect circuit coupled to the pre-amplifying circuit and configured to add sound effects to the pre-amplified signal.

12. The pickup assembly of claim 6, the magnets are composed of one of Alnico, Neodymium, and Samarium-Cobalt.

13. A flexible sensor arrangement for a stringed musical instrument magnetic pickup, comprising:

an elongate flexible substrate having first and second ends, the flexible substrate configured to be placed over a bobbin of the stringed instrument magnetic pickup;

first and second connectors disposed at the first and second ends of the substrate;

a plurality of conducting wires insulated from one another are disposed along the length of the substrate between the first and second connectors;

a first terminal electrically connected to a first one of the plurality of wires;

a second terminal electrically connected to a second one of the plurality of wires; wherein the plurality of wires form a coil when the first and second connectors are engaged.

14. The flexible sensor arrangement of claim 13, wherein the coil senses magnetic field disturbances caused by movement of strings in the stringed musical instrument.

15. The flexible sensor arrangement of claim 14, wherein the musical stringed instrument is an electric guitar.

* * * * *